US007765103B2

(12) United States Patent
Yamazaki

(10) Patent No.: US 7,765,103 B2
(45) Date of Patent: Jul. 27, 2010

(54) RULE BASED SPEECH SYNTHESIS METHOD AND APPARATUS

(75) Inventor: Nobuhide Yamazaki, Kanagawa (JP)

(73) Assignee: Sony Corporation (JP)

( * ) Notice: Subject to any disclaimer, the term of this patent is extended or adjusted under 35 U.S.C. 154(b) by 1139 days.

(21) Appl. No.: 10/864,130

(22) Filed: Jun. 9, 2004

(65) Prior Publication Data

US 2005/0119889 A1 Jun. 2, 2005

(30) Foreign Application Priority Data

Jun. 13, 2003 (JP) ..... P2003-169989

(51) Int. Cl.
*G10L 13/00* (2006.01)

(52) U.S. Cl. ..... 704/259; 704/255; 704/257

(58) Field of Classification Search ..... 704/260, 704/258, 261, 266, 270, 231, 268, 270.1, 704/257, 235, 259, 7
See application file for complete search history.

(56) References Cited

U.S. PATENT DOCUMENTS 6,226,614 B1 * 5/2001 Mizuno et al. ..... 704/260
6,665,641 B1 * 12/2003 Coorman et al. ..... 704/260

FOREIGN PATENT DOCUMENTS

| | | | |
|---|---|---|---|
| JP | 64-078300 | A | 3/1989 |
| JP | 06-318094 | A | 11/1994 |
| JP | 07-056591 | A | 3/1995 |
| JP | 08-248972 | A | 9/1996 |
| JP | 2002-082686 | A | 3/2002 |

* cited by examiner

*Primary Examiner*—Huyen X. Vo
(74) *Attorney, Agent, or Firm*—Lerner, David, Littenberg, Krumholz & Mentlik, LLP

(57) ABSTRACT

A rule based speech synthesis apparatus by which concatenation distortion may be less than a preset value without dependency on utterance, wherein a parameter correction unit reads out a target parameter for a vowel from a target parameter storage, responsive to the phoneme at a leading end and at a trailing end of a speech element and acoustic feature parameters output from a speech element selector, and accordingly corrects the acoustic feature parameters of the speech element. The parameter correction unit corrects the parameters, so that the parameters ahead and behind the speech element are equal to the target parameter for the vowel of the corresponding phoneme, and outputs the corrected parameters.

13 Claims, 5 Drawing Sheets

RULE BASED SPEECH SYNTHESIS METHOD AND APPARATUS

BACKGROUND OF THE INVENTION

1. Field of the Invention

This invention relates to a method and an apparatus for synthesizing the rule based speech by concatenating speech units extracted from speech data.

2. Description of Related Art

A rule based speech synthesizing apparatus for synthesizing the speech by concatenation of speech units extracted from speech data has so far been known. In this rule based speech synthesizing apparatus, the speech waveform is first generated and the prosody is imparted to the so generated speech waveform to output the synthesized speech. In this case, it is known that unit for synthesis, by which the speech is synthesized for generating the speech waveform, significantly affects the quality of the as-synthesized speech.

In particular, the deterioration of the sound quality due to concatenation distortion caused by mismatching at the junction of the synthesis units poses a problem. Several methods have so far been proposed for optimizing the synthesis units for preventing the adverse effect of the concatenation distortion. For example, the technology called phoneme environment clustering (COC) is disclosed in the Japanese Laid-Open Patent Publication S64-78300 entitled 'Speech Synthesis Method', whilst the method for selecting an optimum speech unit, with the phoneme as the smallest unit, by wine-pressing an optimum candidate depending on phoneme linkage in the use environment, is disclosed in the Japanese Laid-Open Patent Publication H8-248972 entitled 'Rule Based Speech Synthesis Apparatus'.

[Patent Publication 1]

Japanese Laid-Open Patent Publication S64-78300

[Patent Publication 2]

Japanese Laid-Open Patent Publication H8-248972

The conventional methods, shown in the above Patent Publications 1 and 2, reside in selecting a relatively small number of sets of speech elements, which will statistically reduce the concatenation distortion, from a relatively large quantity of the synthesis units contained in a speech database. In case the rule based speech synthesis is carried out using the set of the speech segments obtained by this method, there is raised a problem that the quality of the synthesized speech is varied depending on uttered contents. That is, there persists a drawback that, even though the concatenation distortion is small and the speech synthesized imparts a smooth hearing feeling, when an uttered sentence is synthesized, the combination of speech elements, suffering from the concatenation distortion, is used when another uttered sentence is synthesized, such that the resulting synthesized speech imparts an extraneous sound feeling at the junction of the speech elements.

SUMMARY OF THE INVENTION

It is therefore an object of the present invention to overcome the above problem and to provide a method and an apparatus whereby it is possible to reduce the concatenation distortion to less than a preset level without dependency on the particular utterance.

For accomplishing the above object, the rule based speech generating apparatus according to claim 1 of the present invention comprises speech element set storage means for storing a plurality of phoneme strings, each having a vowel phoneme on the boundary, as a speech element, along with feature parameters, as a speech element set, speech element selection means for reading out acoustic feature parameters of a corresponding speech element, from the speech element set storage means, based on an input phoneme string, target parameter storage means having stored therein representative acoustic feature parameters from one vowel to another, parameter correction means for reading out a target parameter for a vowel from the target parameter storage means, responsive to the acoustic feature parameter of the speech element, output from the speech element selection means, and for correcting the acoustic feature parameter of the speech element based on the target parameters, time-series data generating means for concatenating plural acoustic feature parameters output from the parameter correction means to generate time series data of the acoustic feature parameters, and speech synthesizing means for uttering and outputting speech signals of the synthesized speech corresponding to the input phoneme strings in accordance with time-series data of the acoustic feature parameters, corresponding to the input phoneme strings, generated by the time-series data generating means.

With this rule based speech synthesis apparatus, in which a target parameter for a vowel is read out from the target parameter storage means, responsive to the acoustic feature parameters of a speech element, output from the speech element selection means, and the so read out acoustic feature parameters of the speech element are corrected, based on the target parameter, the concatenation distortion may be lower than a preset level.

For accomplishing the above object, the rule based speech generating apparatus according to claim 5 of the present invention comprises a speech element selecting step of reading out an acoustic feature parameter corresponding to a speech element, based on input phoneme strings, from speech element set storage means, adapted for storing a plurality of phoneme strings, each having a vowel phoneme on the boundary, as a speech element, along with feature parameters, as a speech element set, a parameter correction step of reading out a target parameter for a vowel, responsive to the acoustic feature parameters of the speech element output in the speech element selecting step from the target parameter storage means having stored therein the representative acoustic feature parameters from one vowel to another, and for correcting the acoustic feature parameters of the speech element based on the target parameter, a time series data generating step of generating time series data of the acoustic feature parameters by concatenating the acoustic feature parameters output from the parameter correction step, and a speech synthesis step of uttering and outputting a speech signal of the synthesized speech, corresponding to the input phoneme strings, in accordance with the time series data of the acoustic feature parameters, corresponding to the input phoneme strings, generated in the time series data generating step.

With this rule based speech synthesis method, in which the target parameter for the vowel is read out from the target parameter storage means, having stored therein the representative acoustic feature parameters, from vowel to vowel, depending on the acoustic feature parameter of the speech element output in the speech element selecting step, the acoustic feature parameters of the speech element are corrected, based on the target parameter, and the so corrected parameters are concatenated to generate time series data of the acoustic feature parameters, the concatenation distortion may be lower than a preset level.

A rule based speech synthesis apparatus according to claim 6 of the present invention comprises speech element set storage means for storing a plurality of phoneme strings, each having a vowel phoneme on the boundary, as a speech element, along with feature parameters of each speech element, as a speech element set, speech element selection means for reading out acoustic feature parameters of a corresponding speech element, from the speech element set storage means, based on an input phoneme string, target parameter storage means having stored therein a plurality of acoustic feature parameters from one vowel to another, parameter correction means for selecting a specified acoustic feature parameter, responsive to an acoustic feature parameter of the speech element selection means, from plural acoustic feature parameters stored in the target parameter storage means, and for correcting the acoustic feature parameter of the speech element responsive to the selected specified acoustic feature parameter, time-series data generating means for concatenating plural acoustic feature parameters output from the parameter correction means to generate time series data of the acoustic feature parameters, and speech synthesizing means for uttering and outputting speech signals of the synthesized speech corresponding to the input phoneme strings, based on time-series data of the acoustic feature parameters, corresponding to the input phoneme strings, generated by the time-series data generating means.

With the rule based speech synthesis apparatus, a specified acoustic feature parameter is selected responsive to an acoustic feature parameter from plural acoustic feature parameters stored in the target parameter storage means, having stored therein plural acoustic feature parameters, from vowel to vowel, the acoustic feature parameters of the speech element are corrected responsive to the selected specified acoustic feature parameter, and the so corrected acoustic feature parameters are concatenated to generate time-series data of the acoustic feature parameters.

A rule based speech synthesis apparatus according to claim 11 of the present invention comprises a speech element set selecting step of reading out and outputting an acoustic feature parameter of a corresponding speech element, based on input phoneme strings, from speech element set storage means, adapted for storing plural phoneme strings, each having a vowel phoneme on the boundary, as a speech element, as a set of the speech element with the acoustic feature parameter, a parameter correcting step of selecting, from plural acoustic feature parameters stored in target parameter storage means, having stored therein plural acoustic feature parameters, from vowel to vowel, a specified acoustic feature parameter, responsive to the acoustic feature parameter of the speech element output from the speech element selecting step, and for correcting the acoustic feature parameter of the speech element, based on the selected specified acoustic feature parameter, a time-series data generating step of concatenating plural acoustic feature parameters output from the parameter correction step to generate time series data of the acoustic feature parameters, and speech synthesizing means for uttering and outputting speech signals of the synthesized speech, corresponding to the input phoneme strings, in accordance with time-series data of the acoustic feature parameters, corresponding to the input phoneme strings, generated by the time-series data generating means.

With the rule based speech synthesis method, a specified acoustic feature parameter is selected responsive to an acoustic feature parameter from plural acoustic feature parameters stored in the target parameter storage means, having stored therein plural acoustic feature parameters, from vowel to vowel, the acoustic feature parameters of the speech element are corrected responsive to the selected specified acoustic feature parameter, and the so corrected acoustic feature parameters are concatenated to generate time-series data of the acoustic feature parameters.

A rule based speech synthesizing apparatus according to claim 12 of the present invention comprises speech element correction means for correcting a speech element set, having phoneme strings and data of acoustic feature parameters beforehand, and speech synthesizing means for synthesizing the speech corresponding to input phoneme strings, using an as-corrected speech element set, obtained by the speech element correction means, based on an input phoneme string.

With this rule based speech synthesizing apparatus, the speech corresponding to the input phoneme strings is synthesized, using the as-corrected speech element set, based on the input phoneme strings.

A rule based speech synthesizing method according to claim 14 of the present invention comprises a parameter correction step of correcting a speech element set having phoneme strings and data of acoustic feature parameters beforehand, and an as-corrected speech element set storage step of storing the as-corrected speech element set corrected by the parameter correction means, a speech element selecting step of reading out and outputting the acoustic feature parameter corresponding to a phoneme string from the as-corrected speech element set storage step based on input phoneme strings, a parameter time series generating step of concatenating acoustic feature parameters output from the speech element selecting step to generate time-series data of acoustic feature parameters, and a speech synthesizing step of uttering and outputting speech signals of the synthesized speech corresponding to the input phoneme string based on time-series data of acoustic feature parameters corresponding to the input phoneme strings generated by the parameter time series generating step.

With this rule based speech synthesizing method, the speech corresponding to the input phoneme strings is synthesized, using the as-corrected speech element set from the speech element correction step, based on the input phoneme strings.

A rule based speech synthesis apparatus according to claim 15 of the present invention comprises speech element set storage means for storing a plurality of phoneme strings, each having a consonant phoneme on the boundary, as a speech element, along with feature parameters, as a speech element set, speech element selection means for reading out acoustic feature parameters of a corresponding speech element, from the speech element set storage means, based on input phoneme strings, target parameter storage means having stored therein a representative acoustic feature parameter from one consonant to another, parameter correction means for reading out a target parameter for a consonant from the target parameter storage means, responsive to the acoustic feature parameters of the speech element, output from the speech element selection means, and for correcting the acoustic feature parameters of the speech element based on the target parameters, time-series data generating means for concatenating plural acoustic feature parameters output from the parameter correction means to generate time series data of the acoustic feature parameters, and speech synthesizing means for uttering and outputting speech signals of the synthesized speech corresponding to the input phoneme strings in accordance with time-series data of the acoustic feature parameters, corresponding to the input phoneme strings, generated by the time-series data generating means.

With this rule based speech synthesis apparatus, in which the target parameter for a consonant is read out from the target parameter storage means, responsive to the acoustic feature parameters of the speech element, output by the speech element selection means, and the acoustic feature parameters of the speech element are corrected based on the target parameter, the concatenation distortion may be reduced to less than a preset level.

A rule based speech synthesis method according to claim 16 of the present invention comprises a speech element selecting step of reading out acoustic feature parameters of a corresponding speech element, based on an input phoneme string, from speech element set storage means, adapted for storing a plurality of phoneme strings, each having a consonant phoneme on the boundary, as a speech element, along with feature parameters, as a speech element set, a parameter correction step of reading out a target parameter for a consonant, responsive to the acoustic feature parameters of the speech element, output in the speech element selecting step from the target parameter storage means, having stored therein the representative acoustic feature parameters, from one consonant to another, and for correcting the acoustic feature parameters of the speech element based on the target parameter, a time series data generating step of generating time series data of the acoustic feature parameters by concatenating the acoustic feature parameters output from the parameter correction step, and a speech synthesis step of uttering and outputting a speech signal of the synthesized speech, corresponding to the input phoneme strings, in accordance with the time series data of the acoustic feature parameters, corresponding to the input phoneme strings, generated in the time series data generating step.

With this rule based speech synthesis method, in which the target parameter for a consonant is read out from the target parameter storage means, having stored therein a representative acoustic feature parameter, from consonant to consonant, responsive to the acoustic feature parameters of the speech element, output by the speech element selection step, the acoustic feature parameters of the speech element are corrected, based on the target parameter, and the so corrected parameters are concatenated to generate time series data of the acoustic feature parameters, the concatenation distortion may be reduced to less than a preset level.

With the rule based speech synthesis apparatus according to the present invention, in which the target parameter for a vowel is read out from target parameter storage means, responsive to the acoustic feature parameters of the speech element output by the speech element selection means, and the acoustic feature parameters of the speech element are corrected, based on the so read out target parameter, the concatenation distortion may be lesser than a preset level, while a high quality synthesized speech, free of concatenation distortion, may be produced. By proper selection of the feature parameters of the vowels, as targets, the synthesized speech of high clarity, exhibiting well-defined characteristics for the vowels, may be produced, because the vowel part of the target is corrected in keeping with the target.

With the rule based speech synthesis apparatus according to the present invention, in which the target parameter for a vowel is read out from target parameter storage means, having stored therein the representative acoustic feature parameters, from vowel to vowel, responsive to the acoustic feature parameters of the speech element output by the speech element selection step, the acoustic feature parameters of the speech element are corrected, based on the target parameter, and the so corrected acoustic feature parameters are concatenated to form time series data of the acoustic feature parameters, the concatenation distortion may be lesser than a preset level, while a high quality synthesized speech, free of concatenation distortion, may be produced. By proper selection of the feature parameters of the vowels, as targets, the synthesized speech of high clarity, exhibiting well-defined characteristics for the vowels, may be produced, because the vowel part of the target is corrected in keeping with the target.

With the rule based speech synthesis apparatus, according to the present invention, in which specified acoustic feature parameters are selected from the plural acoustic feature parameters, stored in the target parameter storage, from vowel to vowel, depending on the acoustic feature parameters, the acoustic feature parameters of the speech element are corrected, depending on the specified acoustic feature parameters, as selected, and the acoustic feature parameters, thus corrected, are concatenated to form time series data of the acoustic feature parameters, such a target is selected which will reduce the amount of correction, depending on the selected speech element, and the acoustic feature parameters are corrected by this target, such a synthesized speech of high quality may be produced which is able to cope with the case in which the characteristics of the vowel cannot be uniquely determined due to e.g. the phoneme environment.

With the rule based speech synthesis method, according to the present invention, in which specified acoustic feature parameters are selected from the plural acoustic feature parameters, stored in the target parameter storage, from vowel to vowel, depending on the acoustic feature parameters, the acoustic feature parameters of the speech element are corrected, depending on the specified acoustic feature parameters, as selected, and the acoustic feature parameters, thus corrected, are concatenated to form time series data of the acoustic feature parameters, such a target is selected which will reduce the amount of correction, depending on the selected speech element, and the acoustic feature parameters are corrected by this target, such a synthesized speech of high quality may be produced which is able to cope with the case in which the characteristics of the vowel cannot be uniquely determined due to e.g. the phoneme environment.

With the rule based speech synthesis apparatus, according to the present invention, in which the speech corresponding to the input phoneme strings is synthesized, using the as-corrected speech element set, obtained by the speech element correction means, based on the input phoneme strings, it is possible to reduce the volume of processing for synthesis.

With the rule based speech synthesis method, according to the present invention, in which the speech corresponding to the input phoneme strings is synthesized, using the as-corrected speech element set, obtained by the speech element correction step, based on the input phoneme strings, it is possible to reduce the volume of processing for synthesis.

With the rule based speech synthesis apparatus, according to the present invention, in which the target parameter for the consonant is read out from the target parameter storage means, responsive to the acoustic feature parameters of the speech element output from the speech element selection unit, and the acoustic feature parameters for the consonant are corrected based on the so read out target parameter, the concatenation distortion may be lesser than a preset level, while a high quality synthesized speech, free of concatenation distortion, may be produced. By proper selection of the feature parameters of the consonants, as targets, the synthesized speech of high clarity, exhibiting well-defined characteristics for the consonants, may be produced, because the consonant part of the target is corrected in keeping with the target.

With the rule based speech synthesis method according to the present invention, in which the target parameter for a consonant is read out from target parameter storage means, having stored therein the representative acoustic feature parameters, from consonant to consonant, responsive to the acoustic feature parameters of the speech element output by the speech element selection step, the acoustic feature parameters of the speech element are corrected, based on the target parameter, and the so corrected acoustic feature parameters are concatenated to form time series data of the acoustic feature parameters, the concatenation distortion may be lesser than a preset level, while a high quality synthesized speech, free of concatenation distortion, may be produced. By proper selection of the feature parameters of the consonants, as targets, the synthesized speech of high clarity, exhibiting well-defined characteristics for the consonants, may be produced, because the consonant part of the target is corrected in keeping with the target.

DESCRIPTION OF THE PREFERRED EMBODIMENTS

Figure 1:
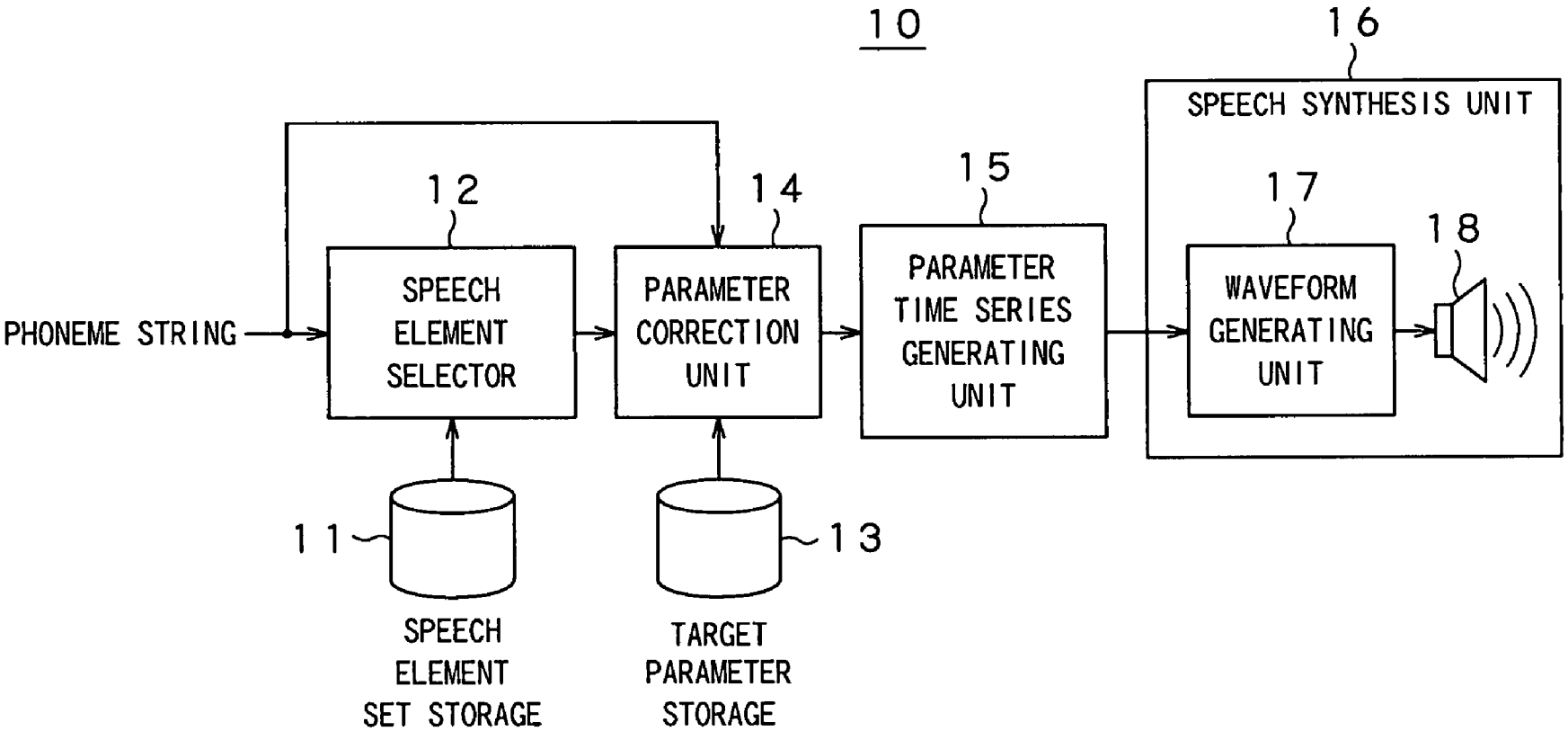
FIG. 1 is a block diagram of a rule based speech synthesis apparatus according to a first embodiment of the present invention.

Referring now to the drawings, certain preferred embodiments of the present invention are explained in detail. FIG. 1 depicts a block diagram of a rule based speech synthesis apparatus 10 according to a first embodiment of the present invention.

The rule based speech synthesis apparatus 10 concatenates phoneme strings (speech elements) having, as the boundary, the phonemes of vowels, representing steady features, that is the phonemes with a stable sound quality not changed dynamically, to synthesize the speech. The rule based speech synthesis apparatus 10 has, as subject for processing, a phoneme string expressed for example by VCV, where V and C stand for a vowel and for a consonant, respectively.

Referring to FIG. 1, the rule based speech synthesis apparatus 10 of the first embodiment is made up by a speech element set storage 11, having stored therein plural speech element sets, a speech element selector 12 for selecting acoustic feature parameters from the speech element set storage 11, based on input phoneme strings, and outputting the selected acoustic feature parameters, a target parameter storage 13, having stored therein representative acoustic feature parameters, from vowel to vowel, a parameter correction unit 14 for correcting the acoustic feature parameters of the unit speech elements, a time series data generating unit 15, generating time series data of the acoustic feature parameters, and a speech synthesis unit 16 for uttering and outputting speech signals of the synthesized speech corresponding to the input phoneme strings.

The speech element set, stored in the speech element set storage 11, is a data pair composed of a phoneme string and acoustic feature parameters, and may be constructed using the conventional technique as previously explained. That is, the speech element set may be constructed by holding on memory a set of a speech element and characteristics parameters obtained on A/D conversion and spectral analyses based on speech signals uttered by a given speaker. The spectral analyses used for obtaining characteristics parameters may be enumerated by, for example, cepstrum analysis, short-term spectral analyses, short-term autocorrelation analyses, band filter bank analyses, formant analyses, line spectrum pair (LSP) analyses, linear prediction code (LPC) analyses and partial autocorrelation analyses (PARCOR analyses). The cepstrum analysis, for example, takes the logarithm of the short-term spectrum and inverse Fourier transforms the resulting log. By representing the spectral envelope of the speech by cepstrum, the poles of the spectrum and zero characteristics may be expressed approximately. It is noted however that limitations have been imposed in formulating the speech element set so that the speech element boundary represents the phoneme boundary of the vowel representing steady-state characteristics.

The phoneme string, as an input to the speech element selector 12, is the data representing a phoneme string obtained by the morpheme analysis of text speech synthesis and by the phonetic symbol string generating processing.

The speech element selector 12 refers to the speech element set storage 11, based on the aforementioned input phoneme string, to select the phoneme string (morpheme) contained in the input phoneme string, to read out the acoustic feature parameters, such as cepstrum coefficients or formant coefficients, from the speech element set storage 11.

The vowel target parameter storage 13 holds parameters of representative vowels, from vowel to vowel. These parameters are not temporally changing parameters, but parameters at a preset point. Meanwhile, these parameters may be optionally selected from the outset from the aforementioned unit morpheme sets.

The parameter correction unit 14 reads out the target parameters for vowels, from the target parameter storage 13, depending on the phonemes at the beginning and the end of the speech element and acoustic feature parameters output from the speech element selector 12, and accordingly corrects the acoustic feature parameters of the speech element. The parameter correction unit is supplied with a time series of the parameters and corrects the parameters so that the parameters ahead and at back of the speech element are equal to the target parameters for vowels of the associated phonemes, in a manner which will be explained subsequently. The parameter correction unit outputs the so corrected parameters.

The parameter time series generating unit 15 concatenates the parameters, as corrected by the parameter correction unit 14, and generates a time series of parameters, as a sequence of acoustic feature parameters associated with the aforementioned input phonemes, to output the so generated time series of parameters. That is, the parameter time series generating unit links the output acoustic feature parameters from the parameter correction unit 14 together to generate and output the time series data of the acoustic feature parameters.

The speech synthesis unit 16 is made up by a waveform generating unit 17 and a loudspeaker 18. The waveform generating unit 17 generates synthesized speech signals for the input phoneme string, based on time series data of the acoustic feature parameters corresponding to the aforementioned input phoneme string, generated by the parameter time series generating unit 15. In particular, the speech synthesis unit 16 synthesizes the speech, using the aforementioned characteristics parameters, and uses the partial autocorrelation (PARCOR) system, line spectrum pair (LSP) system or the cepstrum system. The synthesized speech signals are uttered by the loudspeaker 18 and output. That is, the speech synthesis unit 16 synthesizes speech signals by the waveform generating unit 17, by e.g. the PARCOR system, LSP system or the cepstrum system, based on a sequence of acoustic feature parameters, output from the parameter time series generating unit 15, to output the so synthesized speech signals from the loudspeaker 18.

Figure 2A:
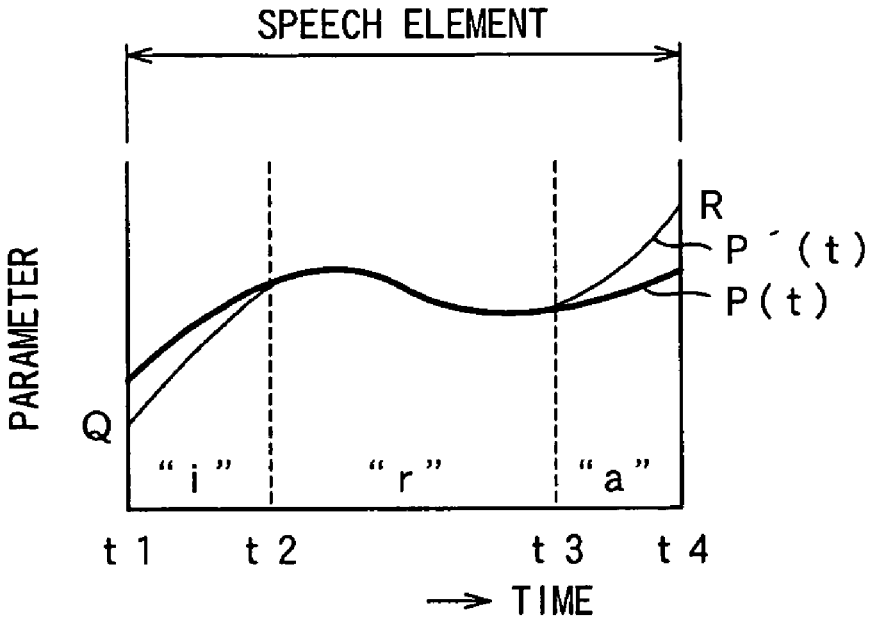
FIG. 2 illustrates two concrete examples of a correction operation of a parameter correction unit as an essential component of the rule based speech synthesis apparatus according to the first embodiment of the present invention.

The processing by the parameter correction unit 14, featuring the present invention, is now specifically explained. FIG. 2A shows a method for correcting the single morpheme. Although this figure conceptually shows one-dimensional parameters, the parameters actually involved are multidimensional vectors. The abscissa plots the time.

In the present instance, the leading phoneme is /i/, so that the parameter /i/ is acquired from the vowel target parameter storage 13. The single speech element is corrected so that the parameter value progressively becomes equal to the value of the target Q towards the near side from a location apart a preset length from the leading end. By 'a location apart a preset length from the leading end' is meant a mid point of V (vowel) which is /i/. This processing may be represented by the following equation (1):

$$P'(t)=(Q-P(t1)(t2-t)/(t2-t1)+P(t) \quad (1)$$

where P(t) is an original parameter at a time (t), P'(t) is an as-corrected parameter, Q is a target parameter, t1 is a time of beginning of the speech element, and t2 is the time of end thereof.

In similar manner, the parameter at the trailing end of the speech element is corrected so that the parameter value progressively becomes equal to the value of the target parameter of /a/ from a location apart a preset length from the trailing end. By 'a preset length' is meant a mid point of V (vowel) which is /a/. This processing may be represented by the following equation (2):

$$P'(t)=(R-P(t4)(t-t3)/(t4-t3)+P(t) \quad (2)$$

where P(t) is an original parameter at a time (t), P'(t) is an as-corrected parameter, R is a target parameter, t4 is a trailing time of the speech element, and t3 is the time of the beginning of correction.

The time to terminate the correction t2 and the time to begin the correction t3 may be set to preset time intervals as from t1 and t4, respectively. The time may also be the boundary between V (vowel) and C (consonant), or a amid interval of V, such as 50% or 70% of V. The length of t2−t1 or t4−t3 may also be set so as to be proportionate to the length of the leading and trailing ends of the speech element.

Figure 2B:
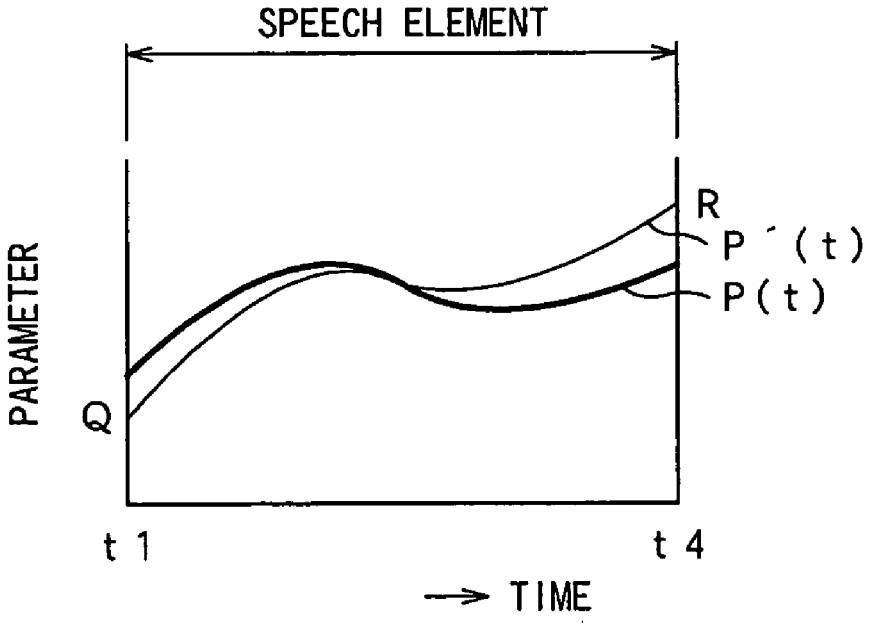

FIG. 2B shows a specified example of another correction method for correcting the speech element in the parameter correction unit 14. In the present example, the domain for correction is expanded to the speech element units entirety. That is, since the speech element units entirety is corrected, there is no domain interruption, such as t2 or t3. The processing may be represented by the following equation (3):

$$P'(t)=(Q-P(t1)(t4-t)/(t4-t1)+(R-P(t4)(t-t1)/(t4-t1)+P(t) \quad (3)$$

where P(t) is an original parameter at time t, P'(t) is an as-corrected parameter, Q is a leading end target parameter, R is a trailing end target parameter, and t1 and t4 are the beginning time and the end time of the speech element, respectively.

With the rule based speech synthesis apparatus 10 of the first embodiment, described above, in which the vowel representing steady features is the boundary of the speech element unit, target parameters are provided from vowel to vowel and the speech element is corrected continuously so that the speech element unit selected at the time of synthesis will be equal to the target parameter, it is possible to generate a high quality synthesized speech free of concatenation distortion.

Figure 3:
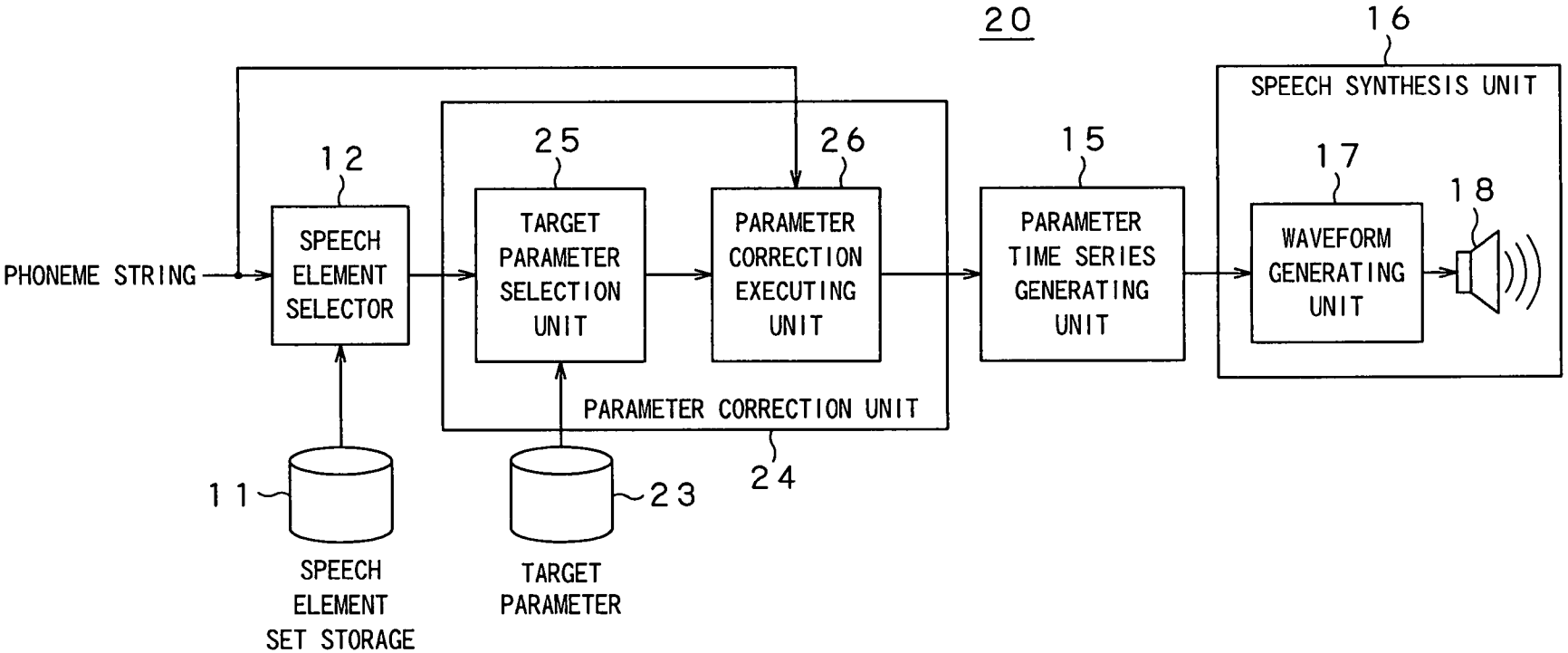
FIG. 3 is a block diagram of a rule based speech synthesis apparatus according to a second embodiment of the present invention.
Figure 4:
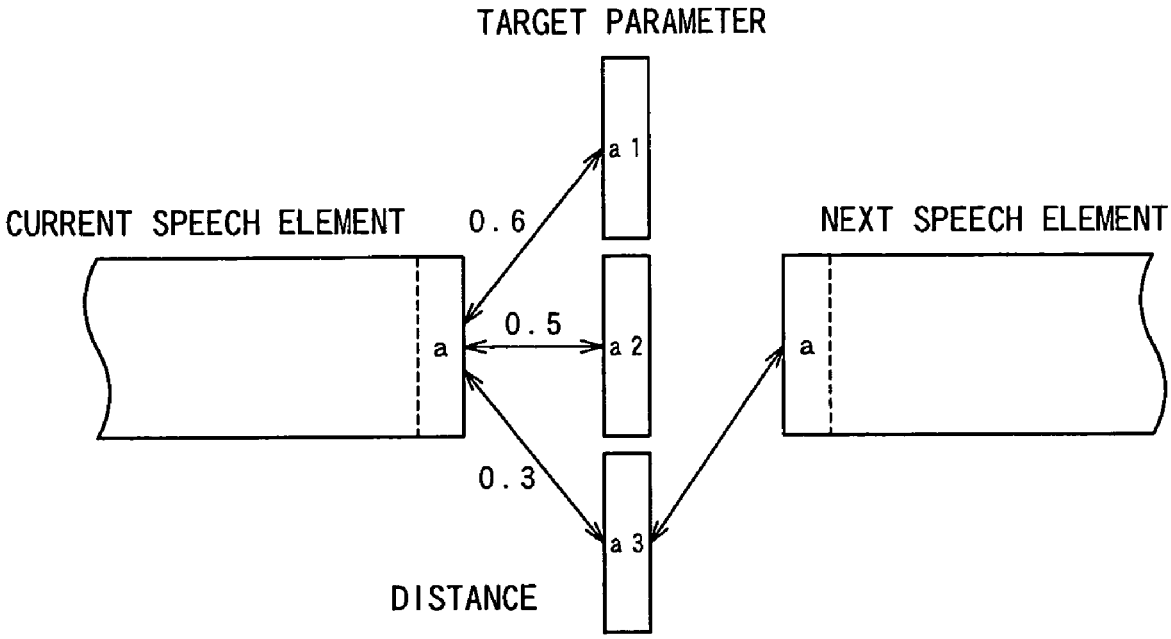
FIG. 4 illustrates a concrete example of an operation of a target selection unit of the parameter correction unit as an essential component of the rule based speech synthesis apparatus according to the first embodiment of the present invention.

Moreover, by proper selection of the characteristics parameters of the target vowel, the vowel part of the parameter is corrected in keeping with the target, so that it is possible to generate the synthesized speech of high clarity having characteristics of clear vowels, Referring to FIGS. 3 and 4, a rule based speech synthesis apparatus according to a second embodiment of the present invention is now explained. Referring to FIG. 3, A rule based speech synthesis apparatus 20 of the second embodiment is made up by a speech element set storage 11, having stored therein plural speech element sets, a speech element selector 12 for selecting acoustic feature parameters from the speech element set storage 11, based on the input phoneme string, and outputting the selected acoustic feature parameters, a target parameter storage 23, having stored therein acoustic feature parameters, representative of the respective vowels, from vowel to vowel, a parameter correction unit 24 for selecting specified acoustic feature parameters of the speech elements from the plural acoustic feature parameters stored in the target parameter storage 23 and for correcting the acoustic feature parameters of the unit speech elements, based on the specified acoustic feature parameters, a time series data generating unit 15, generating time series data of the acoustic feature parameters, and a speech synthesis unit 16 for uttering and outputting speech signals of the synthesized speech corresponding to the input phoneme strings.

In particular, the parameter correction unit 24 functionally includes a target parameter selection unit 25 for selecting specified acoustic feature parameters from the plural acoustic feature parameters, and a parameter correction executing unit 26 for executing the correction of the acoustic feature parameters of the speech elements based on the specified acoustic feature parameters.

The speech element set storage 11, speech element selector 12, parameter time series generating unit 15 and the speech synthesis unit 16 are similar to those used in the above-described first embodiment and hence are not explained here specifically.

The target parameter storage 23 provides several sorts of parameters for each of the vowels /a/, /i/, /u/, /e/ and /o/. For example, there are different sorts of /a/, for example, /a1/ uttered with one's mouth fully open, and /a2/ uttered only indefinitely. There is also /a3/ uttered differently by being affected by the previously uttered consonant. Of course, the same parameter differs with the value of the sound volume. Additionally, the parameter differs with the pitch of the speaker's voice.

For finding plural target parameters from phoneme to phoneme, it is sufficient if the parameters in the vicinity of the boundary ahead and at back of the speech element, and several representative parameters are found, using preexisting vector quantization techniques, for use as target parameters. A large number of the parameters of the respective vowels may be formed into a large set by clustering and classified into plural sorts, e.g. three parameter groups.

The target parameter selection unit 25 in the parameter correction unit 24 is now explained with reference to FIG. 4, showing a case where the vowel of the speech element junction point is /a/. In the present case, three sorts of parameters a1, a2 and a3 are provided as target parameters of /a/.

The target parameter selection unit 25 of the parameter correction unit 24 finds an error between the parameter a at the terminal end of the speech element and three vowel target parameters a1, a2 and a3. The vowel target parameter with the smallest error, that is, the vowel target parameter having characteristics closest to those of the terminal parameter a, is selected. For example, if the distance between the terminal end parameter a of the speech element and the vowel target parameter a1 is 0.6, that between the terminal end parameter a of the speech element and the vowel target parameter a2 is 0.5 and that between the terminal end parameter a of the speech element and the vowel target parameter a3 is 0.3, the distance between the terminal end parameter a of the speech element and the vowel target parameter a3 is shortest and hence this vowel target parameter a3 is selected. As the leading target parameter of the next speech element, the same vowel target parameter as that selected at the terminal end of the previous speech element is selected. The method for correction of the speech element in the parameter correction executing unit 26 is the same as that described above.

It is also possible to select the vowel target parameter so that two errors ahead and at back of the speech element become smaller, instead of selecting the vowel target parameter based on the terminal end of the speech element.

As an implementing method for this case, supposing that, with respect to a target parameter i, an error of a parameter at the trailing end of a previous speech element and an error of a parameter at the leading end of a succeeding speech element are d1*i*, d2*i*, respectively, it is sufficient if the target with the least value of $d1i+\alpha\times d2i$ is selected. Meanwhile, $\alpha$ is a weighting coefficient for previous and succeeding sides and, if, as is a usual case, the weight for the previous side error is to be increased to obtain the stiff speech with a higher quality, $\alpha$ is set to 1 or less. As another implementing method, d1*i* or d2*i*, whichever is larger, is used as an error, and a target parameter i which will render the error smallest is selected. In terms of a mathematical expression, such i is selected which will give MINi(Max(d1*i*, d2*i*)) is found.

With the rule based speech synthesis apparatus 20 of the second embodiment, described above, plural characteristics parameters of target vowels are provided and a target which will reduce the amount of correction depending on the selected speech element is selected and used for correction, so that the synthesized speech with the high quality may be generated which is able to cope with a case in which the characteristics of the vowel cannot be uniquely determined by reason of the phoneme environment.

Figure 5:
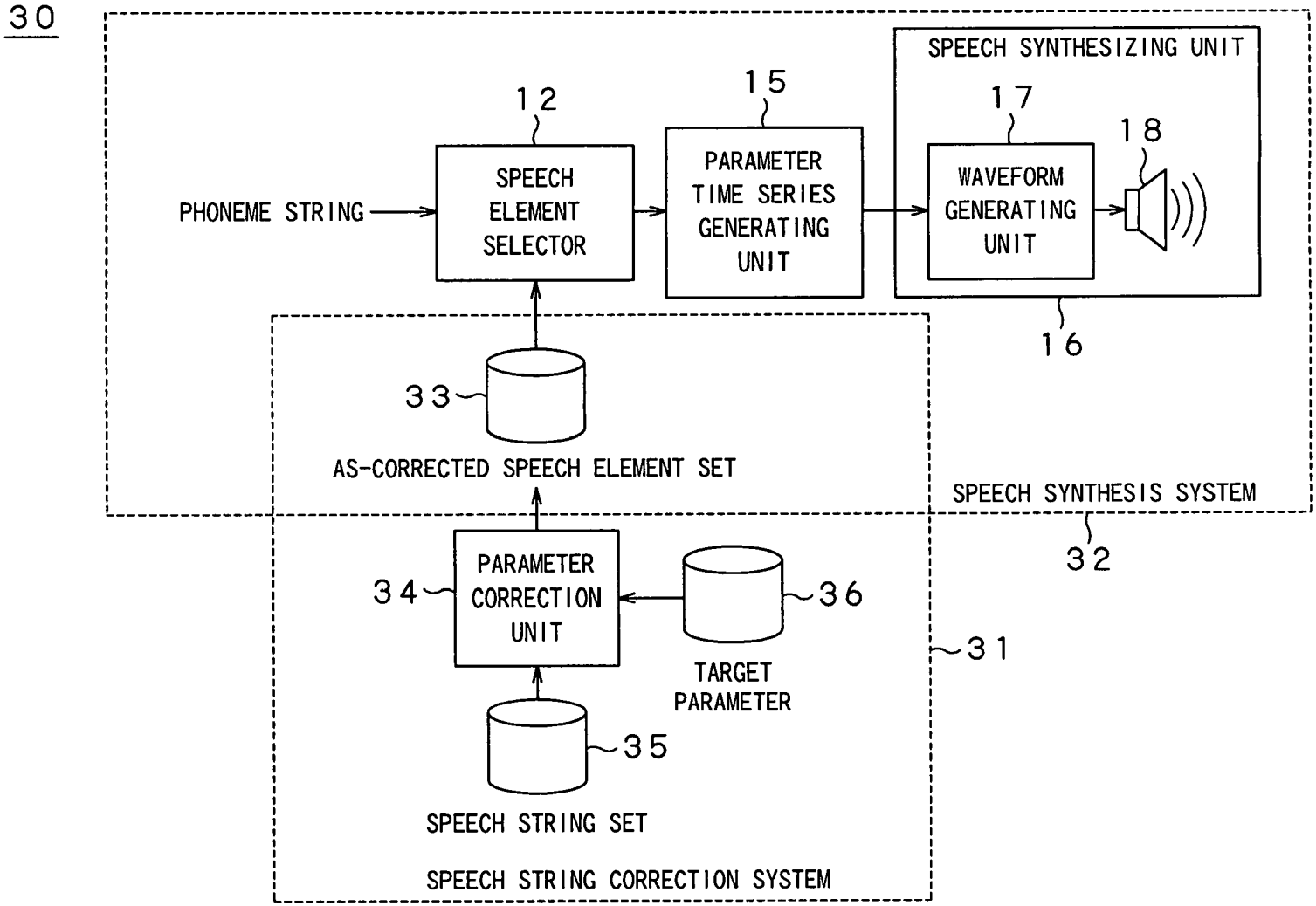
FIG. 5 is a block diagram of a rule based speech synthesis apparatus according to a third embodiment of the present invention.

Referring to FIG. 5, a rule based speech synthesis apparatus 30 according to a third embodiment of the present invention is now explained. This rule based speech synthesis apparatus 30 is divided into a speech element correction system 31 and a speech synthesis system 32.

The speech element correction system 31 is made up by an as-corrected speech element set storage 33, a parameter correction unit 34, a speech element set storage 35, and a target parameter storage 36. A speech element set, having a phoneme string and data of the acoustic feature parameters, is corrected at the outset by a parameter correction unit 34, and stored in the as-corrected speech element set storage 33. The parameter correction unit 34 reads out a target parameter from the target parameter storage 36, having stored therein the representative acoustic feature parameters, from vowel to vowel, while the parameter correction unit 34 reads out acoustic feature parameters from the speech element set storage 35.

In particular, the parameter correction unit 34 reads out vowel target parameters from the target parameter storage 36, depending on the phonemes at the leading and trailing ends of the speech element and the acoustic feature parameters read out from the speech element set storage 35, to correct the acoustic feature parameters of the speech element accordingly to store the so corrected acoustic feature parameters in the as-corrected speech element set storage 33 as a set with the speech element.

The speech synthesis system 32 includes an as-corrected speech element set storage 33, a speech element selector 12 for selecting the as-corrected acoustic feature parameters from the as-corrected speech element set storage 33, based on the input phoneme strings, and for outputting the as-corrected acoustic feature parameters, thus selected, a parameter time series generating unit 15 for generating time-series data of the acoustic feature parameters, selected by the speech element selector 12, and a speech synthesis unit 16 for uttering and outputting speech signals of the synthesized speech corresponding to the input phoneme strings.

The speech element set, stored in the as-corrected speech element set storage 33, is data already corrected by the speech element correction system 31.

The speech element selector 12 refers to the as-corrected speech element set storage 33, based on the aforementioned input phoneme strings, to select the phoneme string (speech element) contained in the input phoneme strings, to read out the acoustic feature parameters corresponding to the selected phoneme string (speech element), such as cepstrum coefficients or formant coefficients, from the as-corrected speech element set storage 33.

The parameter time series generating unit 15 concatenates the parameters, selected by the speech element selector 12, to generate and output parameter time-series data which is the sequence of acoustic feature parameters corresponding to the input phoneme strings.

The speech synthesis unit 16 is made up by a waveform generating unit 17 and a loudspeaker 18. The waveform generating unit 17 generates synthesized speech signals for the input phoneme strings, based on time series data of the acoustic feature parameters, corresponding to the aforementioned input phoneme strings, generated by the parameter time series generating unit 15.

With the present third embodiment of the rule based speech synthesis apparatus 30, in which the as-corrected speech element set in the as-corrected speech element set storage 33 is used, it is unnecessary to carry out parameter correction at the time of the speech synthesis.

Meanwhile, it is possible for the target parameter storage 36 to hold on memory not only the representative sole acoustic feature parameter, from one vowel to another, but also plural acoustic feature parameters from one vowel to another. In the latter case, the parameter correction unit 34 corrects the acoustic feature parameters, read out from the speech element set storage 35, responsive to the totality of the acoustic feature parameters, to store the totality of the as-corrected acoustic feature parameters in the as-corrected speech element set storage 33.

With the present third embodiment of the rule based speech synthesis apparatus 30, in which there is provided the as-corrected speech element set, obtained on correcting the speech element set beforehand, it is possible to reduce the processing volume at the time of the speech synthesis.

In the above-described first to third embodiments, the phoneme at the boundary of the speech element is a vowel. However, the phoneme at the boundary of the speech element is not limited to the vowel and unvoiced sound and may be a consonant not significantly featured by dynamic changes of the acoustic features, such as a nasal sound.

Turning to FIG. 1, by way of reference, a target parameter for a consonant is read out from the target parameter storage 13, responsive to the acoustic feature parameters of the speech element, output from the read out speech element selector 12, and the parameter correction unit 14 corrects the acoustic feature parameters of the speech element, based on the target parameter. Hence, the concatenation distortion may be reduced to less than a preset level. The synthesized speech free of concatenation distortion may be generated. By proper selection of the feature parameters of the consonant, as a target, the consonant part of the parameters can be corrected in keeping with the target, and hence the synthesized speech of high clarity, having the feature of a clear consonant, maybe generated.

Thus, with the rule based speech synthesis apparatus of the present invention, VCVCV or CVC, in addition to VCV, described above, may be the subject of speech synthesis.

What is claimed is:

1. A rule based speech synthesis apparatus comprising speech element set storage means for storing a plurality of phoneme strings, each having a vowel phoneme on a boundary thereof, as a speech element, along with feature parameters, as a speech element set;

speech element selection means for reading out acoustic feature parameters of a corresponding speech element from said speech element set storage means, based on an input phoneme string;

target parameter storage means having stored therein representative acoustic feature parameters from one vowel to another;

parameter correction means for reading out a target parameter comprising acoustic parameters from one vowel to another for a vowel from said target parameter storage means in response to the acoustic feature parameter of the speech element output from said speech element selection means and for correcting the acoustic feature parameter of said speech element based on said target parameters, the acoustic feature parameter being corrected according to at least one predetermined equation wherein the corrected acoustic feature parameter is a function of at least a first target value for a parameter at a leading edge of said speech element and a second target value for a parameter at a trailing edge of said speech element, the corrected acoustic feature having a value equal to said first target value at said leading edge of said speech element and a value equal to said second target value at said trailing edge of said speech element;

time-series data generating means for concatenating plural acoustic feature parameters output from said parameter correction means to generate time series data of the acoustic feature parameters; and speech synthesizing means for uttering and outputting speech signals of the synthesized speech corresponding to the input phoneme strings in accordance with time-series data of the acoustic feature parameters, corresponding to the input phoneme strings, generated by said time-series data generating means.

2. The rule based speech synthesis apparatus according to claim 1 wherein said parameter correction means corrects the acoustic feature parameters of the speech element from a leading end to a leading end to a trailing end of the speech element as a subject of correction.

3. The rule based speech synthesis apparatus according to claim 1 wherein said parameter correction means determines a temporal boundary of a leading end and a trailing end of the speech element as said plurality of phoneme strings as a fixed length.

4. The rule based speech synthesis apparatus according to claim 1 wherein said parameter correction means determines a temporal boundary of a leading end and a trailing end of the speech element as said phoneme strings in accordance with a boundary of the vowel and the consonant.

5. A rule based speech synthesis method of using a processor to perform steps comprising a speech element selecting step of reading out an acoustic feature parameter corresponding to a speech element, based on input phoneme strings, from a speech element set storage storing a plurality of phoneme strings, each having a vowel phoneme on the boundary, as a speech element, along with feature parameters, as a speech element set;

a parameter correction step of reading out a target parameter comprising acoustic parameters from one vowel to another for a vowel, in response to the acoustic feature parameters of the speech element output in said speech element selecting step from the target parameter storage having stored therein representative acoustic feature parameters from one vowel to another for correcting the acoustic feature parameters of said speech element based on said target parameter, the acoustic feature parameters being corrected according to at least one predetermined equation wherein the corrected acoustic feature parameters are a function of at least a first target value for a parameter at a leading edge of said speech element and a second target value for a parameter at a trailing edge of said speech element, the corrected acoustic feature having a value equal to said first target value at said leading edge of said speech element and a value equal to said second target value at said trailing edge of said speech element;

a time series data generating step of generating time series data of the acoustic feature parameters by concatenating the acoustic feature parameters output from said parameter correction step; and a speech synthesis step of uttering and outputting a speech signal of the synthesized speech, corresponding to said input of phoneme strings, in accordance with the acoustic feature parameters, corresponding to said input phoneme strings, generated in said time series data generating step.

6. A rule based speech synthesis apparatus comprising speech element set storage means for storing a plurality of phoneme strings, each having a vowel phoneme on a boundary thereof, as a speech element, along with feature parameters of each speech element, as a speech element set;

speech element selection means for reading out acoustic feature parameters of a corresponding speech element from said speech element set storage means based on an input phoneme string;

target parameter storage means having stored therein a plurality of acoustic feature parameters from one vowel to another;

parameter correction means for selecting a specified acoustic feature parameter in response to an acoustic feature parameter of said speech element selection means, from target parameters comprising acoustic parameters from one vowel to another stored in said target parameter storage means and for correcting the acoustic feature parameter of the speech element responsive to the selected specified acoustic feature parameter, the acoustic feature parameter being corrected according to at least one predetermined equation wherein the corrected acoustic feature parameter is a function of at least a first target value for a parameter at a leading edge of said speech element and a second target value for a parameter at a trailing edge of said speech element, the corrected acoustic feature having a value equal to said first target value at said leading edge of said speech element and a value equal to said second target value at said trailing edge of said speech element;

time-series data generating means for concatenating plural acoustic feature parameters output from said parameter correction means to generate time series data of the acoustic feature parameters; and speech synthesizing means for uttering and outputting speech signals of synthesized speech corresponding to the input phoneme strings, based on time-series data of the acoustic feature parameters, corresponding to the input phoneme strings, generated by said time-series data generating means.

7. The rule based speech synthesis apparatus according to claim 6 wherein said parameter correction means selects a target parameter having a smallest error between a parameter at a trailing end of the speech element output from said speech element set storage means and a plurality of acoustic feature parameters stored in said target parameter storage means, as a specified acoustic feature parameter.

8. The rule based speech synthesis apparatus according to claim 6 wherein said parameter correction means selects a target parameter from the acoustic feature parameters stored in said target parameter storage means based on an error between a parameter at a trailing end of the speech element output from said speech element set storage means and the acoustic feature parameters store in said target parameter storage means, as a specified acoustic feature parameter.

9. The rule based speech synthesis apparatus according to claim 8 wherein said parameter correction means selects such an acoustic feature parameter having a smallest value of a sum of an error between a parameter at a trailing end of the speech element and said plural acoustic feature parameters and an error between a parameter at a leading end of the speech element and said plural acoustic feature parameters, as a specified acoustic feature parameter.

10. The rule based speech synthesis apparatus according to claim 8 wherein said parameter correction means selects such an acoustic feature parameter from said plural acoustic feature parameters which has an error between the parameter at a trailing end of said speech element and the respective acoustic feature parameters or an acoustic feature parameter from said plural acoustic feature parameters that has an error between the parameter at a leading end of said speech element and the respective acoustic feature parameters, whichever has the smaller error.

11. A rule based speech synthesis method of using a processor to perform steps comprising a speech element set selecting step of reading out and outputting an acoustic feature parameter of a corresponding speech element, based on input phoneme strings, from a speech element set storage adapted for storing plural phoneme strings each having a vowel phoneme on the boundary, as a speech element, as a set of the speech element with the acoustic feature parameter;

a parameter correcting step of selecting, from target parameters comprising acoustic parameters from one vowel to another stored in a target parameter storage, a specified acoustic feature parameter, responsive to the acoustic feature parameter of the speech element output from the speech element selecting step, and for correcting the acoustic feature parameter of the speech element based on the selected specified acoustic feature parameter, the acoustic feature parameter being corrected according to at least one predetermined equation wherein the corrected acoustic feature parameter is a function of at least a first target value for a parameter at a leading edge of said speech element and a second target value for a parameter at a trailing edge of said speech element, the corrected acoustic feature having a value equal to said first target value at said leading edge of said speech element and a value equal to said second target value at said trailing edge of said speech element;

a time-series data generating step of concatenating plural acoustic feature parameters output from said parameter correction step to generate time series data of the acoustic feature parameters; and speech synthesizing means for uttering and outputting speech signals of the synthesized speech, corresponding to the input phoneme strings, in accordance with time-series data of acoustic feature parameters, corresponding to the input phoneme strings, generated by said time-series data generating step.

12. A rule based speech synthesis apparatus comprising speech element set storage means for storing a plurality of phoneme strings, each having a consonant phoneme on a boundary thereof, as a speech element, along with feature parameters, as a speech element set;

speech element selection means for reading out acoustic feature parameters of a corresponding speech element, from said speech element set storage means, based on input phoneme strings;

target parameter storage means having stored therein a representative acoustic feature parameter from one consonant to another;

parameter correction means for reading out a target parameter for a consonant from said target parameter storage means having stored therein target parameters comprising acoustic parameters from one consonant to another, responsive to the acoustic feature parameters of the speech element, output from said speech element selection means, and for correcting the acoustic feature parameters of said speech element based on said target parameters, the acoustic feature parameters being corrected according to at least one predetermined equation wherein the corrected acoustic feature parameters are a function of at least a first target value for a parameter at a leading edge of said speech element and a second target value for a parameter at a trailing edge of said speech element, the corrected acoustic feature having a value equal to said first target value at said leading edge of said speech element and a value equal to said second target value at said trailing edge of said speech element;

time-series data generating means for concatenating plural acoustic feature parameters output from said parameter correction means to generate time series data of the acoustic feature parameters; and speech synthesizing means for uttering and outputting speech signals of synthesized speech corresponding to the input phoneme strings in accordance with time-series data of the acoustic feature parameters, corresponding to the input phoneme strings, generated by said time-series data generating means.

13. A rule based speech synthesis method of using a processor to perform steps comprising a speech element selecting step of reading out acoustic feature parameters of a corresponding speech element, based on an input phoneme string from a speech element set storage adapted for storing a plurality of phoneme strings, each having a consonant phoneme on the boundary, as a speech element, along with feature parameters, as a speech element set;

a parameter correction step of reading out a target parameter for a consonant, responsive to the acoustic feature parameters of the speech element output in said speech element selecting step from the target parameter storage having stored therein target parameters comprising acoustic parameters from one consonant to another, and for correcting the acoustic feature parameters of said speech element based on said target parameter, the acoustic feature parameters being corrected according to at least one predetermined equation wherein the corrected acoustic feature parameters are a function of at least a first target value for a parameter at a leading edge of said speech element and a second target value for a parameter at a trailing edge of said speech element, the corrected acoustic feature having a value equal to said first target value at said leading edge of said speech element and a value equal to said second target value at said trailing edge of said speech element;

a time series data generating step of generating time series data of the acoustic feature parameters by concatenating the acoustic feature parameters output from said parameter correction step; and a speech synthesis step of uttering and outputting a speech signal of synthesized speech, corresponding to said input phoneme strings, accordance with the time series data of the acoustic feature parameters, corresponding to said input phoneme strings, generated in said time series data generating step.

* * * * *